US007477229B2

(12) United States Patent
Wong

(10) Patent No.: US 7,477,229 B2
(45) Date of Patent: Jan. 13, 2009

(54) CLOCK WITH INTELLIGENT BACKLIGHT DEVICE

(75) Inventor: Shu Kwan Wong, Hong Kong (HK)

(73) Assignee: Centre Way Company Limited, New Territories (HK)

( * ) Notice: Subject to any disclaimer, the term of this patent is extended or adjusted under 35 U.S.C. 154(b) by 687 days.

(21) Appl. No.: 11/048,747

(22) Filed: Feb. 3, 2005

(65) Prior Publication Data

US 2006/0066556 A1 Mar. 30, 2006

(30) Foreign Application Priority Data

Sep. 28, 2004 (HK) ..... 04107476

(51) Int. Cl.
*G09G 3/36* (2006.01)

(52) U.S. Cl. ..... 345/102; 345/39; 345/55; 345/76

(58) Field of Classification Search ..... 345/102, 345/39, 55, 76
See application file for complete search history.

(56) References Cited

U.S. PATENT DOCUMENTS 6,904,001 B1 * 6/2005 Rast ..... 368/71
2004/0016058 A1 * 1/2004 Gardiner et al. ..... 7/119

* cited by examiner

*Primary Examiner*—Richard Hjerpe
*Assistant Examiner*—Leonid Shapiro

(57) ABSTRACT

This invention relates to a clock with intelligent backlight device comprising a casing, a power supply, timing components, a printed circuit board, time setting buttons and so forth. The power supply is in the form of dry batteries placed inside the battery box of the casing. Inside the casing there are a backlight device and a backlight source. The backlight device is disposed at the back of the timing components, and the backlight source is disposed at the back of the backlight device. The printed circuit board is installed with integrated circuits, the first output thereof drives and controls the timing components, the input thereof connects to the time setting buttons, while the second output thereof drives and controls the backlight source through a photosensitive resistor and an electronic switch in serial connection. The present invention is powered by dry batteries and is operated by low voltage and current. Further, it can automatically switch on or off the backlight in response to changes in the luminosity of the surroundings. It is convenient to use, and it can also prolong battery life span so as to save resources.

7 Claims, 3 Drawing Sheets

CLOCK WITH INTELLIGENT BACKLIGHT DEVICE

BACKGROUND OF THE INVENTION

The present invention relates to a clock and more particularly pertains to a clock with intelligent backlight device.

The available clocks in the marketplace can generally be divided into analogue type and digital type. Some clocks are equipped with luminous devices to enable users to view the time in the dark. In regard to analogue clocks, some clock surfaces and clock hands are made of luminous material, and so can emit self-generated light in the dark without any electric power. However, since luminous material can only be luminous after absorbing light, it cannot emit light continuously for long. Further, the quality of luminous material varies a lot and the illuminating effect is generally not very good. Surfaces of some analogue clocks are installed with small light bulbs or light emitting diodes. When a user presses a button, the light will be turned on illuminating the clock surface, but it is very difficult and inconvenient to look for the clock and press the button in the dark. With respect to digital clocks, some clocks use light emitting diodes to display the time, but these clocks require alternate currents and they are inconvenient for the users as the locations of the electric cables and sockets may cause problems. Most of the digital clocks in the marketplace display time by way of liquid crystal displays (LCDs), but LCDs themselves are not luminous. In the daytime the time and images can be displayed by reflection of sunlight, but in a dark environment a backlight source must be provided so as to display the images. If the backlight source emits uneven light, the sharpness of the display will be affected.

In addition, clocks that are powered by dry batteries generally do not address the problem of power supply management and are not installed with components that control the voltage or current. For example, when new batteries are used, the LCD device and its backlight device consume higher voltage and current, and so the backlight is brighter. But not for long the backlight of the LCD device will become dim, following the consumption of the electric power of the batteries. This forces the user to replace the batteries before they are used up, which not only causes wastage, but also affects the visual appearance due to inconsistent brightness of the backlight.

Besides, though the above-mentioned clocks can display the time in the dark, they also emit light in the daytime and this wastes electric power. For that reason, there is a market demand for clocks that can automatically switch on the backlight devices in response to changes in the luminosity of the surroundings and can simultaneously provide effective power supply management.

BRIEF SUMMARY OF THE INVENTION

In view of the aforesaid disadvantages now present in the prior art, the present invention provides a clock with intelligent backlight device which is powered by dry batteries and does not require any connection to alternate current.

To attain this, the present invention generally comprises a casing, a power supply, timing components, a printed circuit board, time setting buttons and so forth, wherein the power supply is in the form of dry batteries which are disposed inside the battery box of the casing; inside the casing there are a backlight device and a backlight source, and the backlight device is disposed at the back of the timing components and the backlight source is disposed at the back of the backlight device; the printed circuit board is installed with integrated circuits, the first output thereof drives and controls the timing components and the input thereof connects to the time setting buttons, while the second output thereof drives and controls the backlight source through a photosensitive resistor and an electronic switch in serial connection; the printed circuit board connects with the power supply, the timing components, the time setting buttons, the photosensitive resistor, the electronic switch and the backlight source; the integrated circuits have default programs for timing and for driving and controlling the timing components, receiving signals from the photosensitive resistor so as to control the electronic switch and drive the backlight source to emit light.

The present invention is a clock with intelligent backlight device, wherein the clock is an analogue clock, and the timing components comprises a clock movement, clock hands, clock surface and so forth.

The present invention is a clock with intelligent backlight device, wherein the numeric or graphical part of the clock surface allows light transmission.

The present invention is a clock with intelligent backlight device, wherein the clock hands are made of transparent diffusing films which effectively refract light.

The present invention is a clock with intelligent backlight device, wherein the clock is a digital LCD clock, and the timing components have a LCD device.

The present invention is a clock with intelligent backlight device, wherein the backlight device is a diffusing plate made of a transparent diffusing film, and at the middle part thereof there is the backlight source, and the backlight source is a light emitting diode; the light rays of the backlight source are effectively refracted on the diffusing plate providing even light rays which emit through the transparent part of the clock surface or the LCD device to illuminate the numbers and graphics on the clock surface or the LCD screen.

The present invention is a clock with intelligent backlight device, wherein when the clock is a digital LCD clock, the light emitting diode is disposed perpendicularly to the diffusing plate, the middle part of the light emitting diode with lower light intensity is disposed in the middle of the diffusing plate, the tip of the light emitting diode with the highest light intensity is projected outside from the diffusing plate, and is disposed in a hole on the casing for use as an electric torch.

The present invention is a clock with intelligent backlight device, wherein a reflective coating is disposed on the back of the diffusing plate.

The present invention is a clock with intelligent backlight device, wherein the power supply is a direct current from 1.5 to 6 volts.

The present invention is a clock with intelligent backlight device, wherein the second output of the integrated circuits connects to another integrated circuit to stabilize and control the voltage and current and to output to the backlight source.

It is an object of the present invention to provide a clock with intelligent backlight device which is powered by dry batteries and does not require any connection to alternate current, and is therefore convenient for use.

It is another object of the present invention to provide a clock with intelligent backlight device which has an effective power supply management system which controls the voltage and current in pre-defined range, and thus prolongs the battery life span.

It is another object of the present invention to provide a clock with intelligent backlight device which can use second-hand batteries. For electrical appliances that consume relatively more electricity, such as MP3 players, hand-held radios, electric toys or other small electrical appliances having motors, when their batteries cease to supply electricity, this does not necessarily mean that all electric power of the batteries is used up. Since the voltage and current demands of the present invention are relatively low, the second-hand batteries can be used in the present invention. This can effectively use the batteries and is environmentally friendly.

It is another object of the present invention to provide a clock with intelligent backlight device which has a photosensitive sensitive device and a digital programming component which can automatically switch on or off the light in response to changes in the luminosity of the surroundings. The user does not need to look for the button to switch on the light in the dark, and this is convenient and saves resources.

It is another object of the present invention to provide a clock with intelligent backlight device which uses a diffuser and a light box to provide an effective and even backlight source so that the user can view the time clearly in the dark.

It is a further object of the present invention to provide a clock with intelligent backlight device which consumes little energy and can provide even light intensity, thus overcoming the disadvantages of the prior art.

An even further object of the present invention is to provide a clock with intelligent backlight device which is of simple structure and low manufacturing costs.

DETAILED DESCRIPTION OF THE INVENTION

Figure 1:
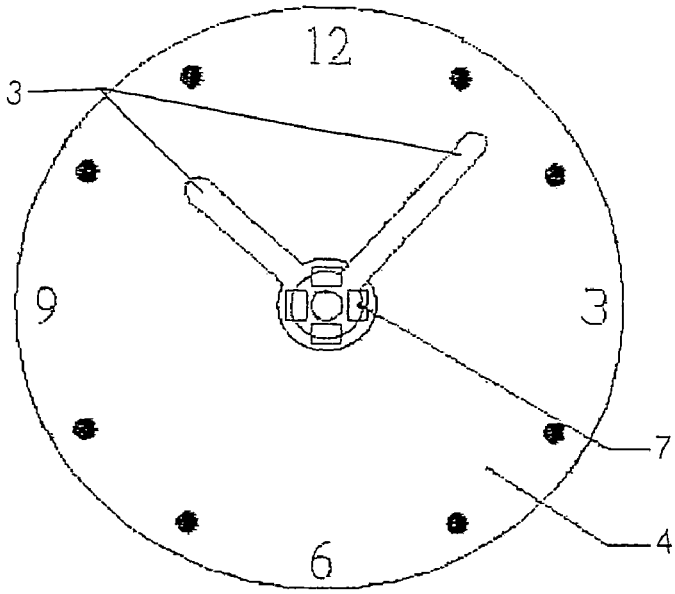
FIG. 1 shows the clock surface of an embodiment of the present invention.
Figure 2:
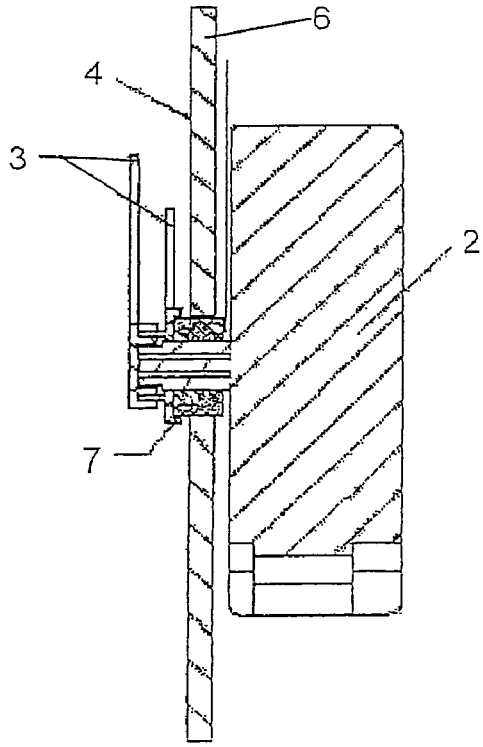
FIG. 2 is the cross-sectional view showing the internal structure of the first embodiment of the present invention.
Figure 3:
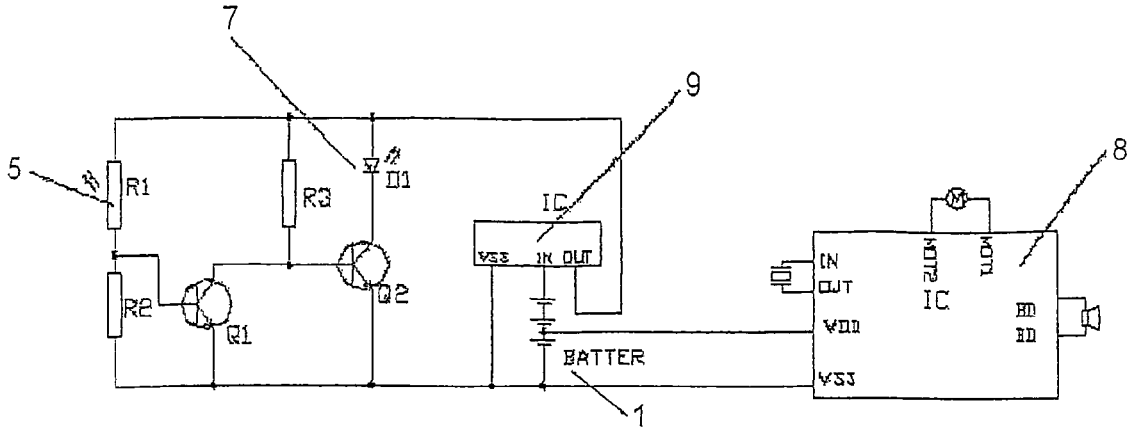
FIG. 3 is the circuit diagram of the first embodiment of the present invention.

FIGS. 1 to 3 illustrate an embodiment of the present invention of a clock with intelligent backlight device. This embodiment is an analogue clock comprising: a casing (not shown), a power supply 1, a printed circuit board, time setting buttons (not shown), a clock movement 2, clock hands 3, a clock surface 4, a photosensitive resistor 5, a diffusing plate 6, light emitting diodes 7 and so forth. The numeric or graphical part of the clock surface 4 allows light transmission. The diffusing plate 6 is disposed at the back of the clock surface 4 and is made of a transparent diffusing plastic film, at the middle part thereof there are two light emitting diodes 7. Light rays of the light emitting diodes 7 are effectively refracted on the diffusing plate 6 providing even light rays which emit through the transparent part of the clock surface 4 to illuminate the numbers and graphics on the clock surface 4. The clock hands 3 are also made of transparent diffusing plastic films and they effectively refract light rays.

The power supply 1 of this embodiment is three AA dry batteries, which are placed in a battery box of the casing and supply a direct current of 4.5 volts. The printed circuit board connects with the power supply 1, the photosensitive resistor 5, the clock movement 2, the time setting buttons and the light emitting diodes 7. The printed circuit board has an integrated circuit 8 with default programs for timing and for driving and controlling the clock movement 2, driving and controlling the light emitting diodes 7 to emit light, and receiving signals from the photosensitive resistor 5 so as to control the light emitting diodes 7 to emit light, and it also has an integrated circuit 9 which stabilizes and controls the output voltage and current. In this embodiment, the integrated circuit 8 is a C1960 model and the integrated circuit 9 which stabilizes and controls the output voltage and current is a XC6206 model and they control the output voltage within the range of 2.7 to 3 volts. The photosensitive resistor 5 of this embodiment will reduce its resistance when the illumination of the surroundings is above or equal to 10 lux, so that an electronic switch formed by Q1 and Q2 will shut off to prevent the light emitting diodes 7 from emitting light. When the illumination of the surroundings is below 10 lux, the resistance will increase, and the electronic switch is connected to allow the light emitting diodes 7 to emit light. Apart from controlling light emission of the light emitting diodes 7 through the photosensitive resistor 5, this embodiment also controls the light emission of the light emitting diodes 7 though the integrated circuits which control the light emitting diodes 7 to emit light continuously for 10 hours from 10 o'clock in the evening to 8 o'clock in the next morning.

Figure 4:
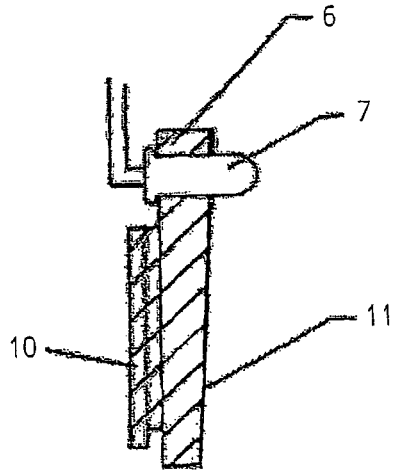
FIG. 4 shows the structure of the light box of another embodiment of the present invention.
Figure 5:
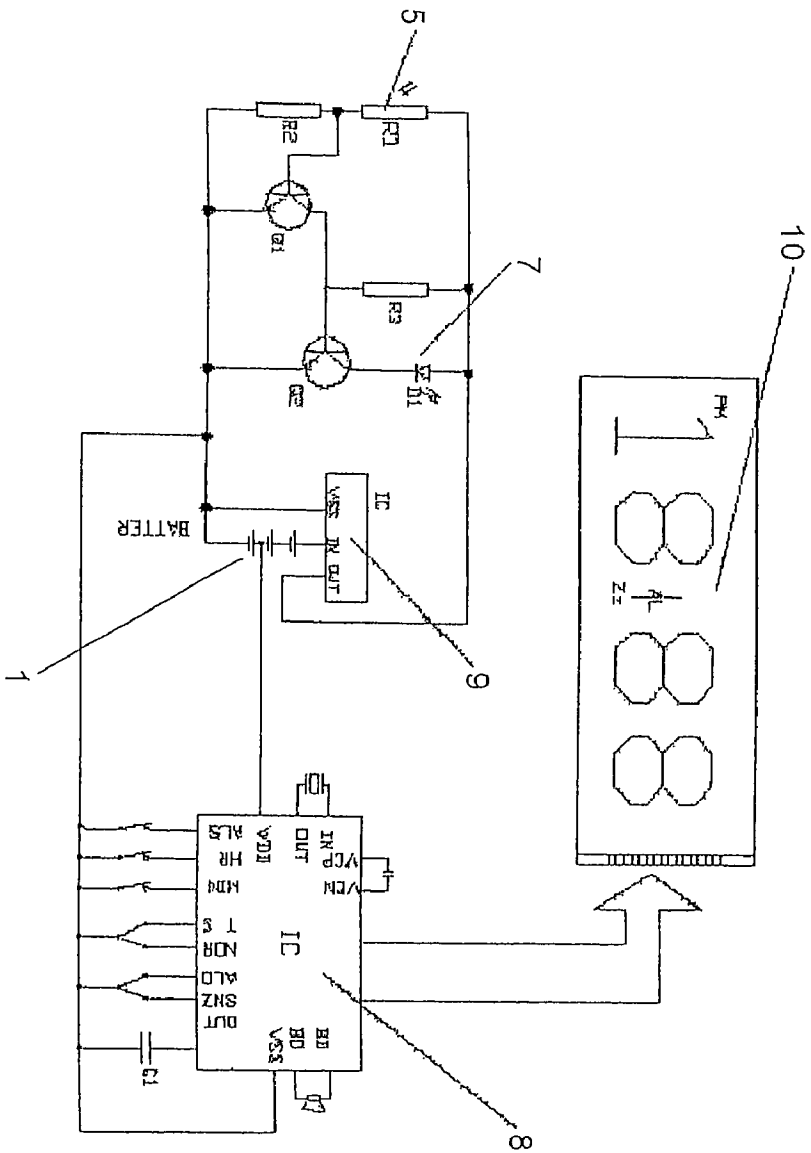
FIG. 5 is the circuit diagram of the second embodiment of the present invention.

FIGS. 4 to 5 illustrate a second embodiment of the present invention. This embodiment is a digital clock comprising: a casing (not shown), a power supply 1, a printed circuit board, time setting buttons (not shown), a LCD device 10, a photosensitive resistor 5, a diffusing plate 6, a light emitting diode 7 and so forth. The diffusing plate 6 is disposed at the back of the LCD device 10 and is made of a transparent diffusing plastic film, at the middle part thereof there is the light emitting diode 7 and at the back thereof there is a reflective coating. In this embodiment, the light emitting diode 7 is disposed perpendicularly to the diffusing plate 6, the middle part of the light emitting diode 7 with lower light intensity is disposed in the middle of the diffusing plate 6 where light rays are effectively refracted. This provides even light rays which emit through the LCD device 10 to illuminate the LCD screen. The tip of the light emitting diode 7 with the highest light intensity is projected outside from the diffusing plate 6 and is disposed in a hole (not shown) on the casing for use as an electric torch.

The power supply 1 of this embodiment is three AA dry batteries, which are placed in a battery box of the casing and supply a direct current of 4.5 volts. The printed circuit board connects with the power supply 1, the photosensitive resistor 5, the time setting buttons, the light emitting diode 7 and the LCD device 10. The printed circuit board has an integrated circuit 8 with default programs for timing and for driving and controlling the LCD device 10, driving and controlling the light emitting diode 7 to emit light, and receiving signals from the photosensitive resistor 5 and control the light emitting diode 7 to emit light, and it also has an integrated circuit 9 which stabilizes and controls the output voltage and current. In this embodiment, the integrated circuit 8 is a C1937AY model and the integrated circuit 9 which stabilizes and controls the output voltage and current is a XC6206 model and they control the output voltage within the range of 2.7 to 3 volts. The photosensitive resistor 5 of this embodiment will reduce its resistance when the illumination of the surroundings is above or equal to 10 lux, so that an electronic switch formed by Q1 and Q2 will shut off to prevent the light emitting diode 7 from emitting light. When the illumination of the surroundings is below 10 lux, the resistance will increase, and the electronic switch is connected to allow the light emitting diode 7 to emit light. Apart from controlling light emission of the light emitting diode 7 through the photosensitive resistor 5, this embodiment also controls the light emission of the light emitting diode 7 though the integrated circuits which control the light emitting diode 7 to emit light continuously for 10 hours from 10 o'clock in the evening to 8 o'clock in the next morning.

The present invention is powered by dry batteries and is operated by low voltage and current. Further, it can automatically switch on or off the backlight in response to changes in the luminosity of the surroundings. It is convenient to use, and it can also prolong battery life span so as to save resources. The present invention consumes little energy and can provide even light intensity. It is also of simple structure and low manufacturing costs.

As to a further discussion of the manner of usage and operation of the present invention, the same should be apparent from the above description. Accordingly, no further discussion relating to the manner of usage and operation is provided.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

The present invention is capable of other embodiments and of being practiced and carried out in various ways. It is to be understood that the phraseology and terminology employed herein are for the purpose of description and should not be regarded as limiting.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

What is claimed is:

1. A clock with intelligent backlight device comprising a casing, a power supply, timing components, a printed circuit board and time setting buttons, wherein: the power supply is in the form of dry batteries which are disposed inside the battery box of the casing;

inside the casing there are a backlight device and a backlight source, and the backlight device is disposed at the back of the timing components and the backlight source is disposed at the back of the backlight device;

the printed circuit board is installed with integrated circuits, the first output thereof drives and controls the timing components and the input thereof connects to the time setting buttons, while the second output thereof drives and controls the backlight source through a photosensitive resistor and an electronic switch in serial connection;

the second output of the integrated circuits connects to another integrated circuit to stabilize and control the voltage and current and to output to the backlight source.

2. A clock with intelligent backlight device as in claim 1, wherein the clock is an analogue clock, and the timing components comprises a clock movement, clock hands and clock surface.

3. A clock with intelligent backlight device as in claim 1 or 2, wherein the numeric or graphical part of the clock surface allows light transmission.

4. A clock with intelligent backlight device as in claim 1 or 2, wherein the clock hands are made of transparent diffusing plastic films.

5. A clock with intelligent backlight device as in claim 1, wherein the backlight device is a diffusing plate made of a transparent diffusing film, and at the middle part thereof there is the backlight source, and the backlight source is a light emitting diode.

6. A clock with intelligent backlight device as in claim 5, wherein a reflective coating is disposed on the back of the diffusing plate.

7. A clock with intelligent backlight device as in claim 1, wherein the power supply is a direct current from 1.5 to 6 volts.

* * * * *